US008459255B2

(12) United States Patent
Spurling et al.

(10) Patent No.: US 8,459,255 B2
(45) Date of Patent: Jun. 11, 2013

(54) RESPIRATORY MUSCLE TRAINING DEVICE

(75) Inventors: David Alastair Spurling, Leamington Spa (GB); Darren Hoe Yung Lam, Kenilworth (GB); Andrew Skelton, Barton-Upon-Humber (GB); Alison Kay McConnell, Bournemouth (GB); Franjo Cecelja, Guildford (GB); Peter Broomhead, Iver (GB)

(73) Assignee: Hab Holdings Limited (GB)

( * ) Notice: Subject to any disclaimer, the term of this patent is extended or adjusted under 35 U.S.C. 154(b) by 342 days.

(21) Appl. No.: 12/737,167

(22) PCT Filed: Jun. 30, 2009

(86) PCT No.: PCT/EP2009/004703
§ 371 (c)(1), (2), (4) Date: Jan. 24, 2011

(87) PCT Pub. No.: WO2010/000439
PCT Pub. Date: Jan. 7, 2010

(65) Prior Publication Data

US 2011/0124470 A1 May 26, 2011

(30) Foreign Application Priority Data

Jul. 1, 2008 (GB) ..... 0811981.0

(51) Int. Cl.
*A61B 5/087* (2006.01)

(52) U.S. Cl.
USPC ..... 128/200.24; 128/200.26

(58) Field of Classification Search
USPC ..... 128/200.24, 201.26, 204.22, 204.26, 128/205.11
See application file for complete search history.

(56) References Cited

U.S. PATENT DOCUMENTS

| | | | |
|---|---|---|---|
| 6,631,716 | B1 | 10/2003 | Robinson |
| 2008/0053452 | A1 | 3/2008 | Brown |
| 2008/0053456 | A1 | 3/2008 | Brown et al. |

FOREIGN PATENT DOCUMENTS

| | | | |
|---|---|---|---|
| WO | WO 2005/006980 | A | 1/2005 |

*Primary Examiner* — Jerome W Donnelly
(74) *Attorney, Agent, or Firm* — Ira S. Dorman

(57) ABSTRACT

A respiratory muscle training device includes a chamber (1) containing a variable orifice valve assembly (3). An inlet (9) is provided at a first side of the valve assembly permitting air to be inhaled into the chamber, and an outlet (11) is provided at a second side of the valve assembly permitting air that has passed through the valve assembly to be inhaled by a user. A pressure sensor (7) determines a pressure differential across the valve assembly. Means is provided for determining the opening area of the valve assembly, and control means (15, 47, 49) is provided for varying the orifice of the valve assembly in dependence upon a pressure differential determined by the pressure sensor and upon an opening area of the valve assembly.

24 Claims, 7 Drawing Sheets

RESPIRATORY MUSCLE TRAINING DEVICE

This invention relates to an respiratory muscle training device, including both inspiratory and expiratory muscle training devices.

Respiratory muscle training devices in the form of inspiratory muscle training devices are well known, for example from GB-A-2 278 545 and U.S. Pat. No. 4,854,574. These known devices each incorporate a chamber having an outlet in the form of a mouthpiece for the passage of air to be inhaled and exhaled, an inlet permitting air to be inhaled to enter the chamber and to pass to the opening, a one-way exhaust valve permitting exhaled air entering through the opening to escape from the chamber, and a valve to resist the entry of air to be inhaled into the chamber, which valve is designed to open at a constant threshold pressure. Although the threshold pressure can be varied by the user from breath to breath or session to session, the known devices effectively present a preselected constant load to inspiration. That is, the load is constant in that it is independent of flow and does not vary with time or lung volume.

However, the mechanical characteristics of the respiratory muscles dictate that their strength (and therefore the pressure they can generate within the lungs) varies according to the degree to which the lungs are inflated. Consequently, subjecting the respiratory muscles to constant resistance loading results either in over-loading of the muscles at high lung volumes resulting, for example, in premature termination of inspiration and/or in sub-optimal loading at low lung volumes.

It is therefore an object of the present invention to provide a respiratory muscle training device which overcomes or at least ameliorates the disadvantages of known devices and is able to provide dynamic loading of the respiratory muscles which varies in relation to varying respiratory muscle capabilities at different lung volumes.

According to the present invention there is provided a respiratory muscle training device comprising:

a chamber containing a variable orifice valve assembly;

an inlet at a first side of the valve assembly permitting air to be inhaled into the chamber;

an outlet at a second side of the valve assembly permitting air that has passed through the valve assembly to be inhaled by a user;

a pressure sensor for determining a pressure differential across the valve assembly;

means for determining the opening area of the valve assembly; and control means for varying the orifice of the valve assembly in dependence upon a pressure differential determined by the pressure sensor and upon an opening area of the valve assembly.

The means for determining the opening area of the valve assembly may include positional feedback means, such as an optical or magnetic encoder, or an actuator for operating the valve assembly may serve as means for determining the opening area of the valve.

The control means may include an actuator for operating the valve assembly. The actuator may be selected from a stepper motor, dc servomotor, ultrasonic motor or other actuator type.

The valve assembly may include a stationary first valve plate having at least one aperture for the passage of air and a second valve plate movable, for example rotatable, relative to the first valve plate and having at least one aperture for the passage of air.

The first and second valve plates may each be formed with a plurality of apertures in the form of a sector of a circle equally spaced around an axis of each valve plate and separated by solid regions of substantially the same dimensions as the apertures.

The valve assembly may include biasing means, such as a coil spring, urging the valve plates towards each other.

The valve assembly may include an end stop to limit relative movement between the first and second valve plates.

The first plate may be mounted in the chamber in a manner which allows an amount of relative movement between the valve plate and the chamber.

The movable valve plate may have a toothed portion around at least a part of the periphery thereof for engaging with the actuator forming part of the control means. The actuator may transfer drive to the movable valve plate by way of one or more gears or by way of a drive belt.

The pressure sensor may include a first port upstream of the valve assembly and a second port downstream of the valve assembly.

The control means may include a signal conditioner for converting an output signal of the pressure sensor into a form adapted for input to the control means.

The control means may include a microprocessor for determining the required opening of the orifice of the valve assembly. The microprocessor may control the orifice, for example, to maintain a predetermined pressure differential, flow rate or resistive load profile, which may be varied for example with volume and/or time. Because the predetermined pressure differential is effectively a pressure differential with respect to atmospheric pressure, the pressure differential is often referred to as mouth pressure $P_{MOUTH}$.

The device may include feedback means for providing information to a user. The feedback means may comprise one or more of an LCD screen, an audible buzzer, light emitting diodes, connection for an external computer, or tactile vibration feedback.

For a better understanding of the present invention and to show more clearly how it may be carried into effect reference will now be made, by way of example, to the accompanying drawings in which.

Figure 1:
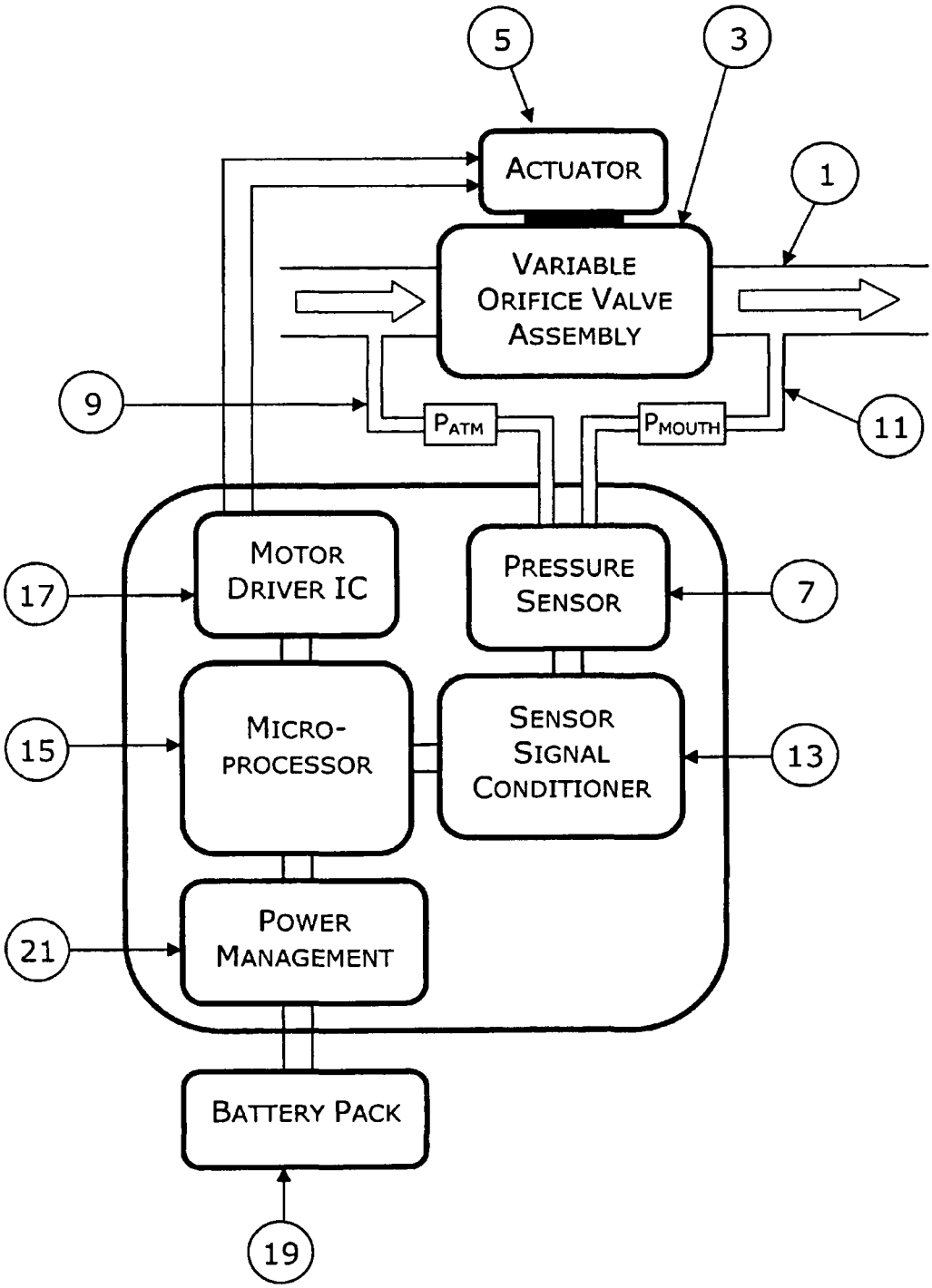
FIG. 1 is a block diagram showing the major components of an embodiment of a respiratory muscle training device according to the present invention.

FIG. 1 illustrates diagrammatically the principles of a respiratory muscle training device according to the present invention, in particular in the form of an inspiratory muscle training device, and shows an air passage 1 with arrows indicating the direction of inspiratory air flow and including a variable orifice valve assembly 3 and an actuator 5, such as a stepper motor, for varying the orifice of the valve assembly, the actuator including means for determining the opening area of the valve assembly. A pressure sensor 7 determines the pressure differential across the valve assembly 3 and for this purpose has a first port 9 communicating with the air passage 1 upstream (during inspiration) of the valve assembly for determining in effect atmospheric pressure $P_{ATM}$, and a second port 11 communicating with the air passage 1 downstream of the valve assembly and determining in effect the pressure in the mouth $P_{MOUTH}$, and therefore the lungs, of a user.

The pressure sensor 7 is connected to a signal conditioner 13 which converts an analogue output of the pressure sensor, for example a piezoresistive pressure sensor, by amplification and filtration to provide a signal that can be used by the microprocessor. In turn an output from the signal conditioner is passed to a microprocessor 15 which determines the required orifice for the device and controls the orifice by way of a motor driver 17 and the actuator 5. Electrical power for the device is provided by a battery pack 19 and a power management system 21.

The orifice of the valve assembly may be controlled in order to implement a varying resistive load to inspiratory airflow in order, for example, to maintain a predetermined pressure differential, flow rate or resistance (as determined by the product of the pressure differential and the flow rate) profile. The load may be varied with respect to volume or time.

Figure 2:
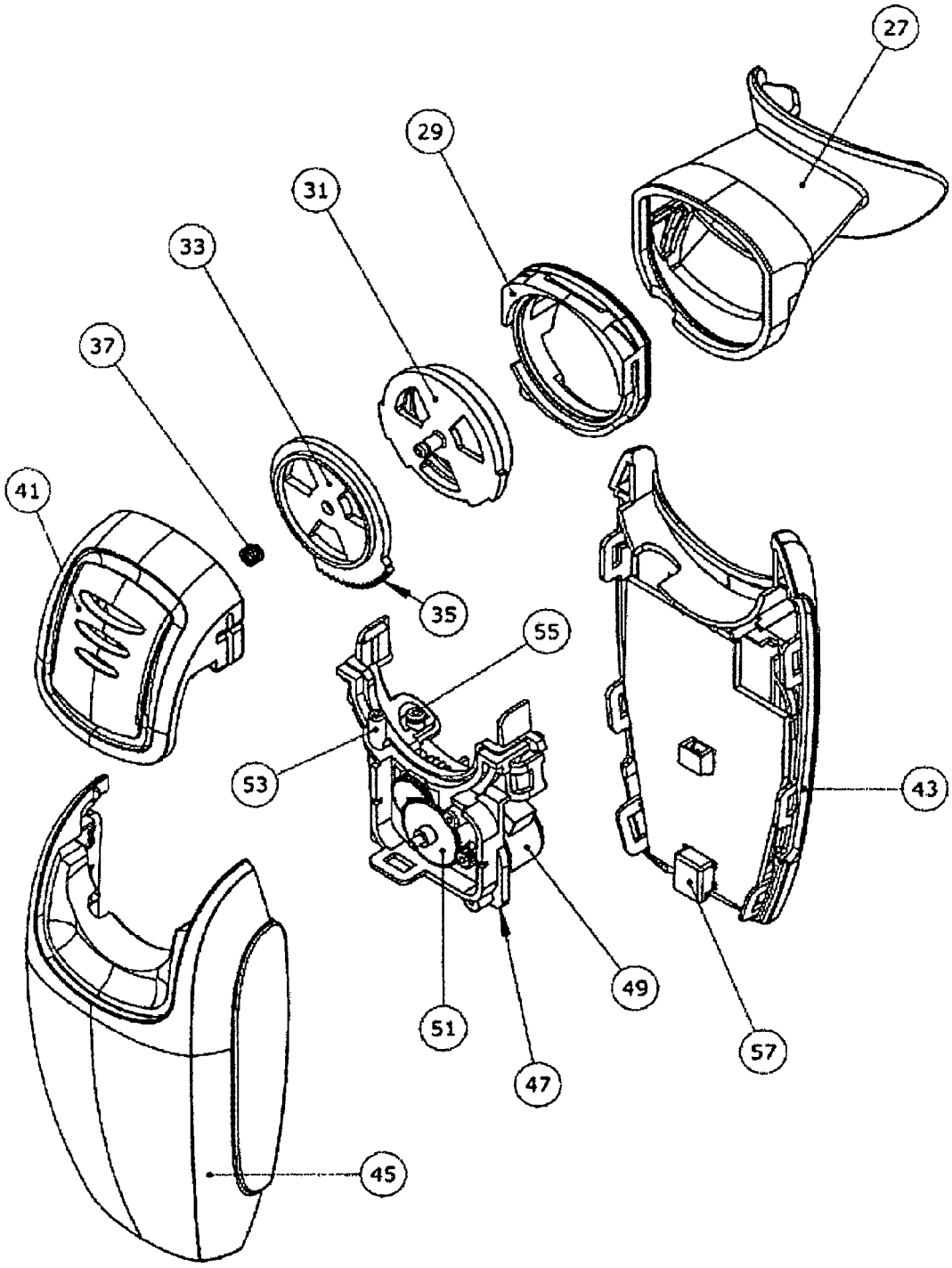
FIG. 2 is an exploded rear perspective view of another embodiment of a respiratory muscle training device according to the present invention.
Figure 3:
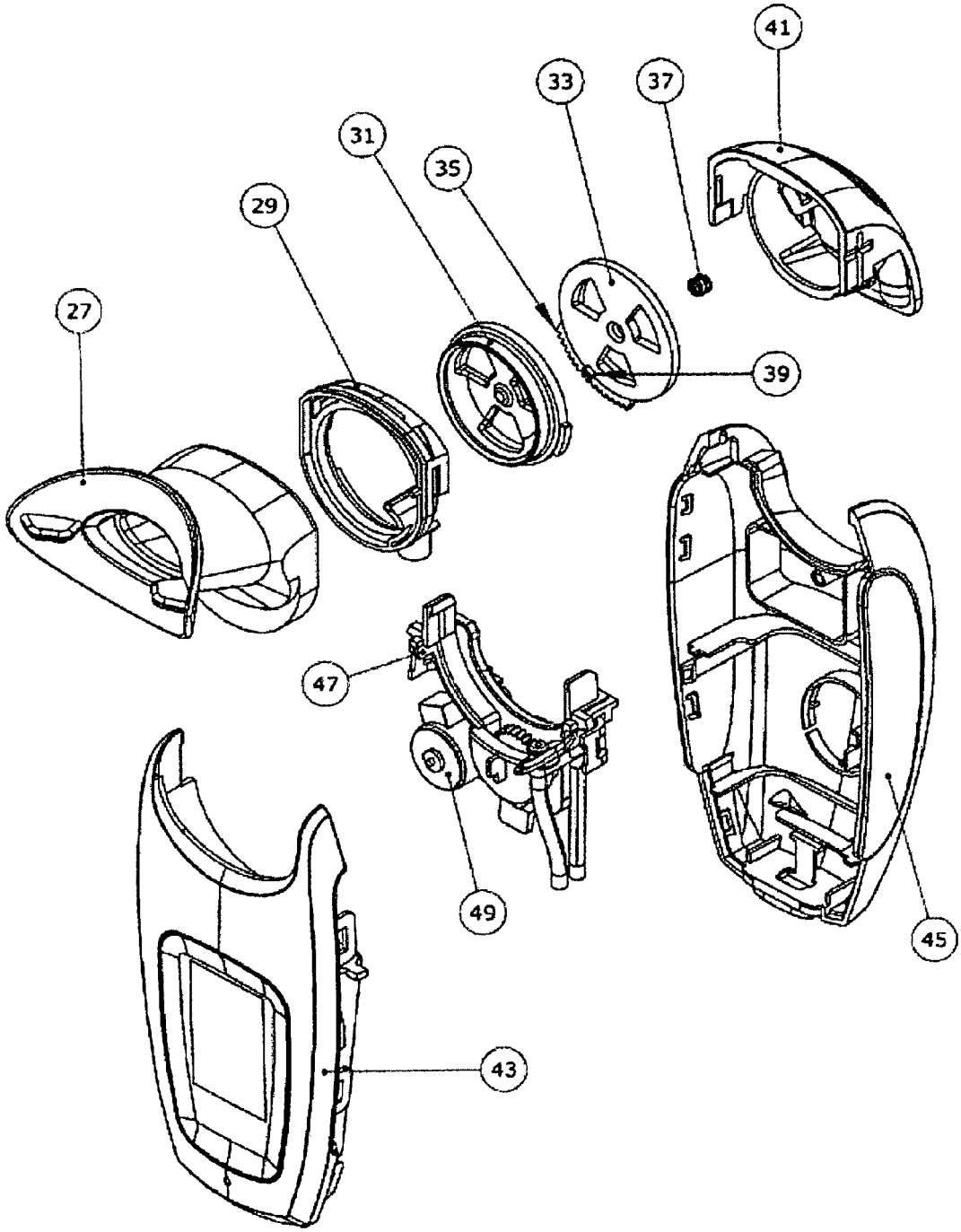
FIG. 3 is an exploded front perspective view of the respiratory muscle training device shown in FIG. 2.
Figure 4:
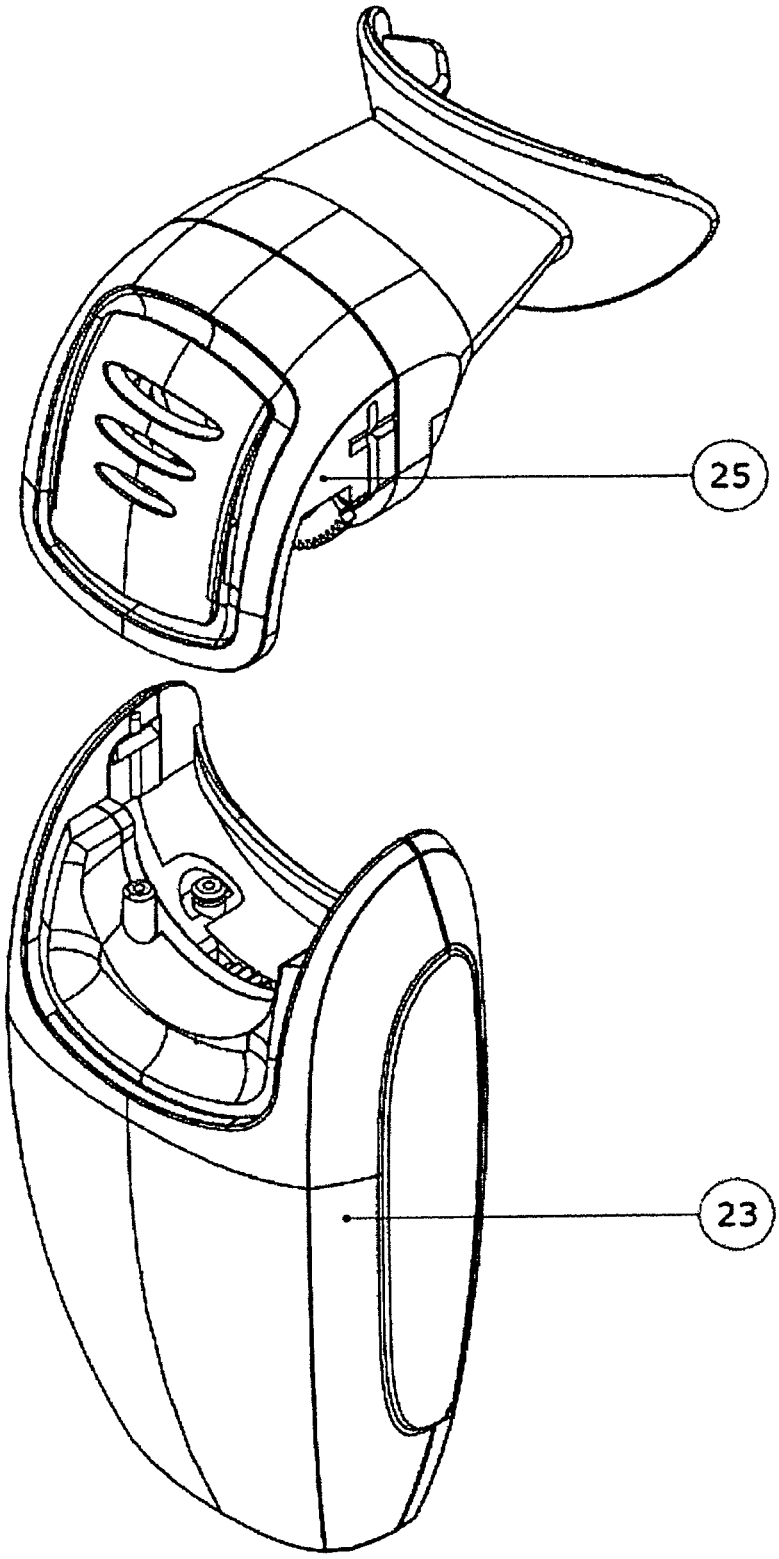
FIG. 4 is a perspective view of the respiratory muscle training device of FIGS. 2 and 3 showing that the device can be separated into two pieces.

The inspiratory muscle training device shown in FIGS. 2 to 4 comprises, as shown in FIG. 4, a body portion 23 and a separable mouthpiece portion 25. The use of a mouthpiece portion 25 which can be separated from the major components of the device allows the mouthpiece portion, with the variable orifice valve assembly, to be cleaned (for example washed) by the user.

The mouthpiece portion comprises a mouthpiece 27 to which is attached a valve housing 29 into which is keyed a substantially circular fixed valve plate 31 having a plurality of apertures. For example, there may be three apertures, each in the form of a sector of a circle, equally spaced around an axis of the valve plate and separated by solid regions of substantially the same dimensions as the apertures. A substantially circular rotatable valve plate 33 having a plurality of apertures is mounted on a spigot protruding axially from the centre of the fixed valve plate 31 and has a toothed portion 35 extending around at least a part of the periphery thereof. For example, the arrangement of apertures may be substantially the same as with the fixed valve plate. Thus the rotatable valve plate 33 is rotatable relative to the fixed valve plate 31 such that, when the two sets of apertures coincide the valve is open to a varying degree and that when the apertures do not coincide the valve is closed. Biasing means 37, such as a coil spring, urges the rotatable valve plate against the fixed valve plate. Where the device is used only as an inspiratory muscle training device, the strength of the biasing means can be relatively low to allow separation of the valve plates during expiration, but if the device is to be used as an expiratory muscle training device then the strength of the biasing spring needs to be sufficient to prevent separation of the valve plates or other measures need to be taken to prevent such separation. Other measures could include reversing the order of the valve plates in a device intended solely as an expiratory muscle training device or sandwiching one of the valve plates between two of the other valve plates in a dual-purpose device. An end stop 39 is formed on one face of the rotatable valve plate 33 to limit rotational movement thereof between a fully closed and a fully open configuration, the end stop engaging in a peripheral recess formed in the fixed valve plate 31. Of course, the number and shape of the apertures in the two valve plates can be changed, for example to determine loading responsiveness, resolution and range. The mouthpiece portion 25 also includes a rear vent 41 through which air enters during inspiration and passes through the valve assembly to the mouthpiece 27. An upper surface of the rear vent 41 forms an upper region of the air passage 1. The keying arrangement between the valve housing 29 and the fixed valve plate 31 allows a small amount of relative rotation in order to allow a small amount of continued rotation after the end stop has prevented further rotation between the two valve plates. This allows the fully closed position of the valve assembly to be accurately reset without the need for positional feedback.

The fully closed (or "home") position of the valve assembly may need to be accurately reset at a known stepper motor position, for example, in the event of step position loss and in the absence of positional feedback data (i.e., during open loop stepper motor operation). The home position is set by the microprocessor 15 instructing the stepper motor 5 to move further than the valve assembly allows due to the end stop 39. When the rotatable valve plate 33 hits the end stop, at either the fully open or fully closed position of the valve assembly, and the stepper motor continues to turn, the valve plates (31, 33) remain stationary relative to each other, but the valve plates together may continue to rotate relative to the valve housing 29. By this method, when the stepper motor is stopped, both the position of the stepper motor and the position of the valve plates relative to each other are known. Movement of the valve plates relative to the valve chamber is deferential to movement of the valve plates relative to each other, so that during normal operation the relative positions of the valve plates, and hence the valve opening area, are always known.

The body portion 23 includes front and rear housing portions 43 and 45. Upper regions of the housing portions are curved to form an interface with the mouthpiece 25. A gearbox 47 includes an arcuate portion also forming part of an interface with mouthpiece portion 25. Mounted onto gearbox 47 is a stepper motor actuator 49 which drives the rotatable valve plate 33 by way of meshed gears 51 which engage with the toothed peripheral portion 35 of the rotatable valve plate. Operation of the stepper motor serves to cause gradual occlusion of opening of the valve assembly in order to vary resistance to respiratory airflow. The stepper motor converts electrical pulses into discrete mechanical movements. The stepper motor incorporates a shaft which rotates in discrete step increments when electrical command pulses are applied to the motor by the microprocessor 15 in a predetermined sequence. Because the discrete movements of the stepper motor are determined by the command pulses sent to it, the rotational position of the shaft, and hence the position (and therefore opening) of the valve, are determined directly by the microprocessor. A first pressure tapping 53 extends into the inlet region of the air passage within the rear vent 41 to provide an indication of atmospheric pressure, while a second pressure tapping 55 is spaced from the first pressure tapping and extends into the outlet region of the air passage within the region of the mouthpiece portion 25 to provide an indication of the pressure within the mouthpiece.

Figure 7:
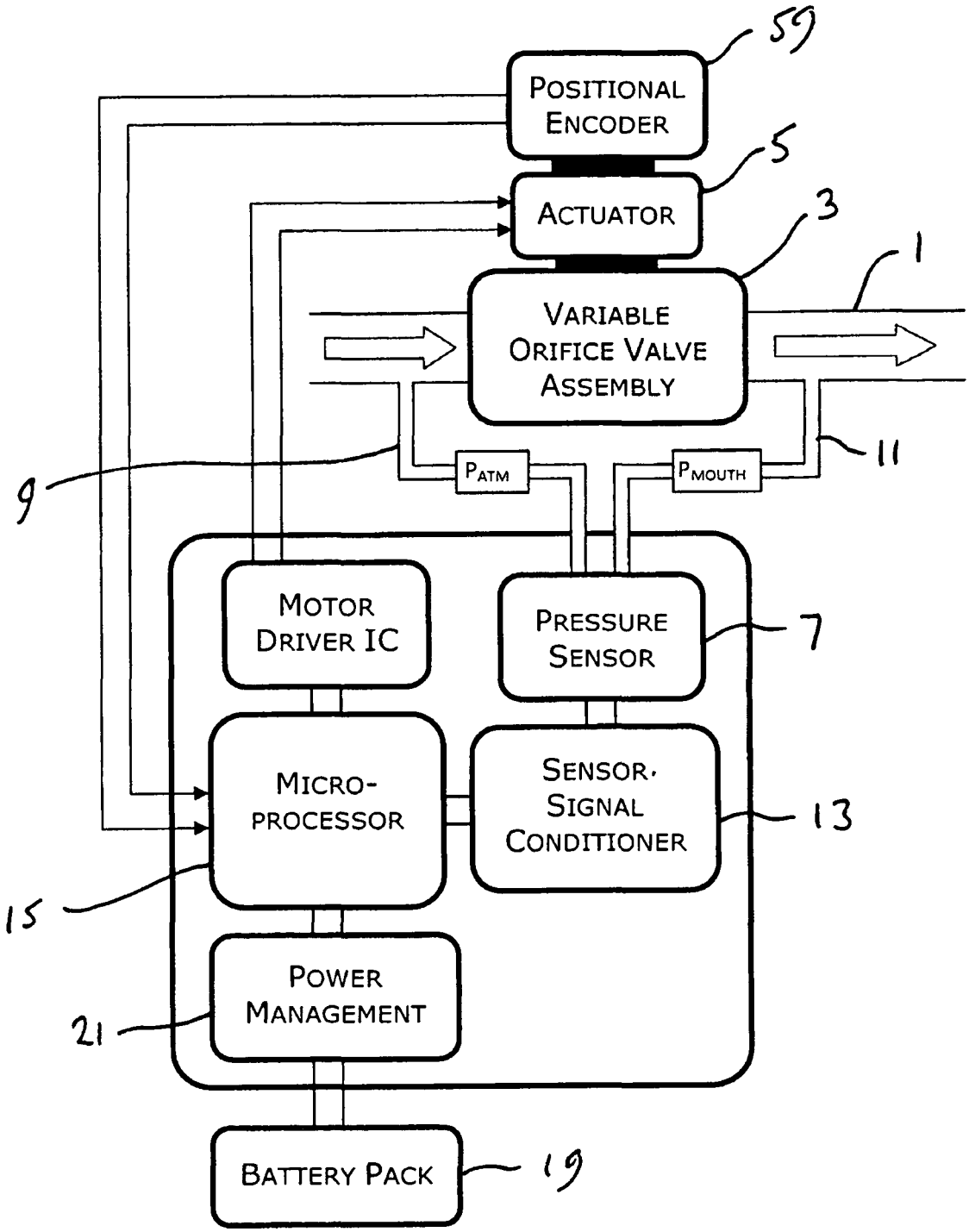
FIG. 7 is a block diagram showing the major components of another embodiment of a respiratory muscle training device according to the present invention.

It should be noted that the meshing gears could be replaced by a drive belt arrangement and that the stepper motor could be replaced by a dc servomotor, ultrasonic motor or other actuator type. Further, as illustrated in FIG. 7, positional feedback means 59 may be provided if desired, for example in the form of an optical or magnetic encoder. The positional feedback means 59 may be attached to either the actuator 49 or the rotatable valve plate 33 in order to determine the position of the valve. When the microprocessor sends commands to the actuator to move the valve plate, the positional encoder provides feedback to the microprocessor on the position of the valve plate so that the microprocessor can calculate air flow and can instruct the actuator to move again to further approximate the required set point, i.e., pressure differential, flow or resistive load profile.

Positional feedback means is particularly useful in situations where the position of the valve cannot be determined directly from the microprocessor commands to the actuator. This generally arises when the actuator is other than a stepper motor and the microprocessor cannot command the actuator to move to a known position.

The electronic components are housed within the body portion 23 but are not shown in FIGS. 2 to 4 and the body portion may include a port 57 for recharging the battery pack. The port 57 may also serve for communication with an external computer.

Pressure differential is sampled by the first and second pressure tappings 53 and 55 and is determined by the pressure transducer 7. The opening area of the valve assembly is known at all times, either by use of the stepper motor actuator 49 described, or by the use of positional encoder feedback means, to determine the position of the rotatable valve plate 33. Flow rate is calculated by the microprocessor 15 in real time using the pressure and area data according to a relationship of the following type:

$$Q=C_F\cdot A\cdot\sqrt{(2\cdot\Delta P/\rho)}$$

where:

Q=flow rate

A=valve opening area

ΔP=pressure differential across the valve assembly $C_F$=flow coefficient

ρ=density

This may be approximated to:

$$Q=K\cdot A\cdot\sqrt{\Delta P}$$

where K is a tabulated variable, dependent on the valve opening area and/or pressure (that is, a dynamic flow coefficient), determined by straightforward experiments on the device. Alternatively, K may be approximated by a constant which can readily be determined by experiment depending on the configuration of the device.

Flow volume is calculated by integrating flow rate with respect to time:

$$V=\int Q\cdot dt$$

In this way, the inspiratory muscle training device according to the present invention is able to determine flow rate, flow volume and mouth pressure with only a pressure sensor.

According to one procedure for using an inspiratory muscle training device according to the present invention, it has previously been demonstrated that variation of maximum inspiratory mouth pressure with lung volume can be approximated for an individual user to:

$$P_{MAX}=P_{MAX(RV)}-(P_{MAX(RV)}\cdot(V^2+2\cdot V)/(VC^2+2\cdot VC))$$

where:

$P_{MAX}$=maximum mouth pressure at a given lung volume

V=lung volume (above residual volume)

VC=user's vital capacity $P_{MAX(RV)}$=user's maximum mouth pressure at residual volume (the volume of air remaining in the user's lungs at the end of a maximum expiration)

In order to ensure optimal training stimulus at all lung volumes, the inspiratory muscle training load is maintained at a fixed proportion of the user's maximum mouth pressure according to the relationship defined above throughout inspiration. For example, for training at 50% $P_{MAX}$:

$$P_{LOAD}=0.5\times P_{MAX}=0.5\times[P_{MAX(RV)}-(P_{MAX(RV)}\cdot(V^2+2\cdot V)/(VC^2+2\cdot VC)]$$

Thus, the present invention provides a respiratory muscle training device which is able to provide variable loading on a user's respiratory muscles, and in particular the user's inspiratory muscles.

In order to set the correct loading for a particular user, values of VC and $P_{MAX(RV)}$ are required.

The value of VC (vital capacity) is directly integrated from calculated flow (in turn, calculated from pressure differential and area data), which is measured during maximum inspiration by the user under a constant low load.

Figure 5:
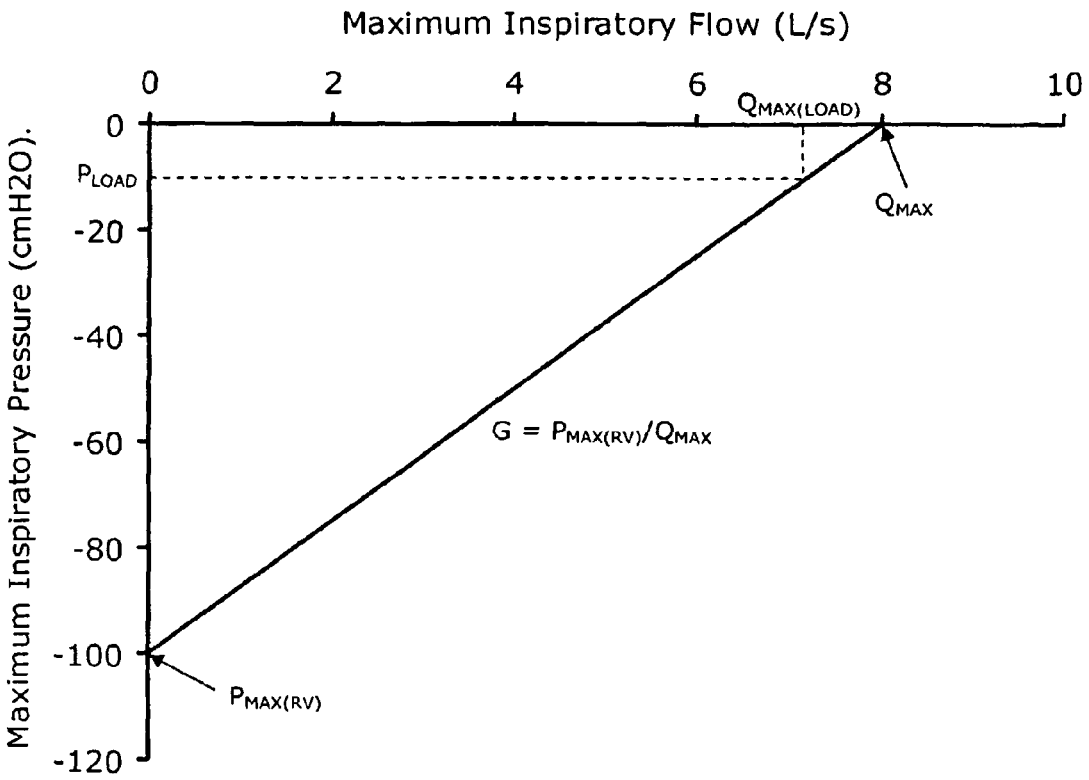
FIG. 5 is a graph showing a maximum pressure-flow relationship.

$P_{MAX(RV)}$ is inferred from measurement of maximum flow ($Q_{MAX(LOAD)}$) during maximum inspiration by the user at a constant low load, using a well-known inverse relationship between maximum inspiratory pressure and maximum flow rate as illustrated in FIG. 5. Other well-known methods may also be used.

Thus:

$$P_{MAX(RV)}=P_{LOAD}+G\cdot Q_{MAX(LOAD)}$$

where:

$P_{LOAD}$=fixed low resistance load implemented during inspiration $Q_{MAX(LOAD)}$=maximum inspiratory flow recorded at $P_{LOAD}$ G=gradient of maximum pressure flow relationship (fixed value, approximated from experimentation)

Figure 6:
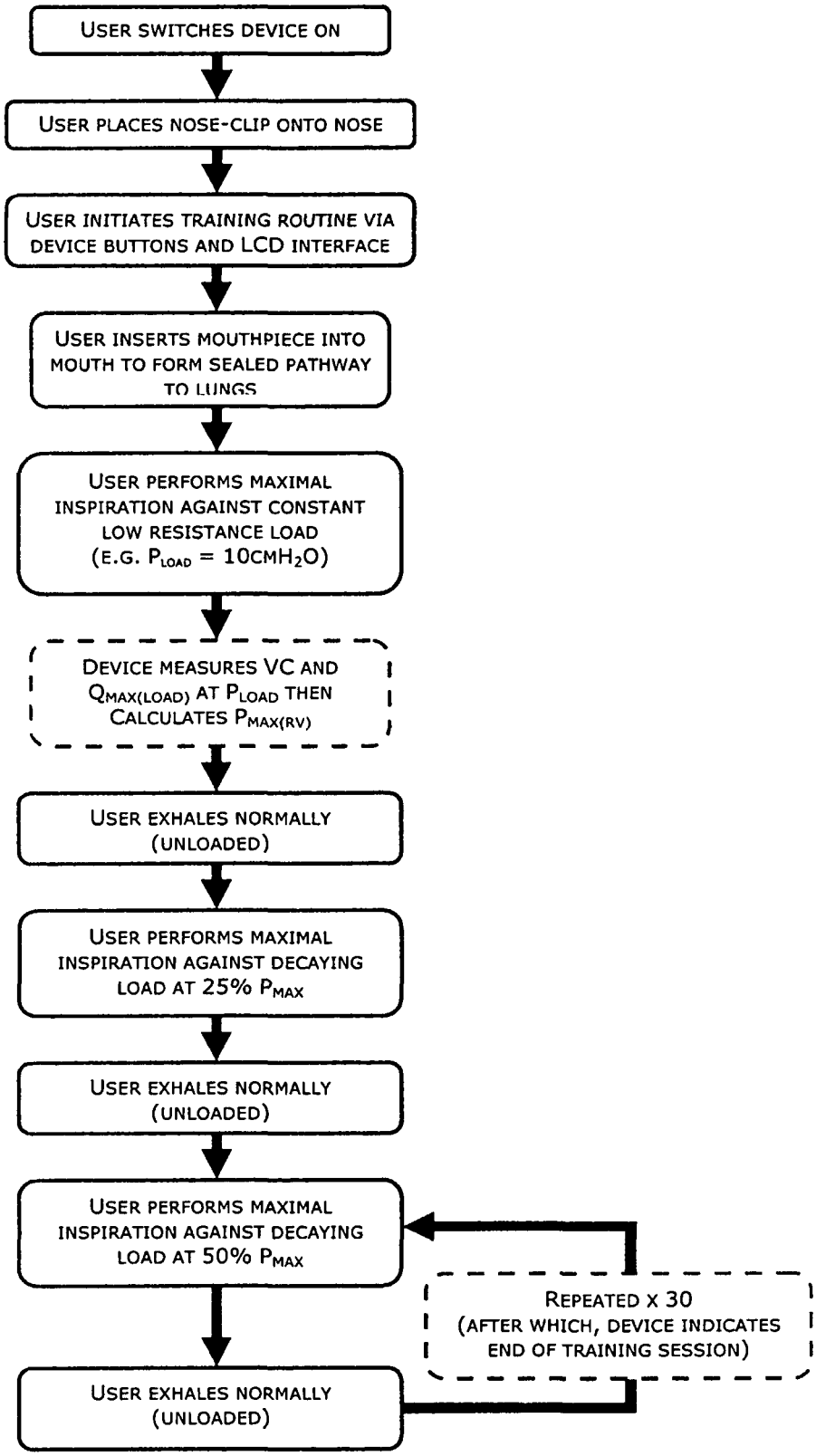
FIG. 6 shows a basic sequence for operation of the device shown in FIGS. 1 to 4.

Once VC and $P_{MAX(RV)}$ have been determined, loading according to the previously defined quadratic relationship may be gradually implemented (for example, 25% $P_{MAX}$ for one breath, followed by 50% $P_{MAX}$ for the next breath) to give the user a staged introduction to loading. A possible basic sequence for operation by which physiological parameters of the user are determined (VC and $Q_{MAX(LOAD)}$), an ideal loading profile is determined, and loading is implemented for inspiratory airflow, is shown in FIG. 6.

The training sequence is initiated by the user via a user interface. The user then inhales maximally through the device while the variable orifice valve assembly maintains a constant low mouth pressure (for example 10 cm $H_2O$). During this inspiration, the user's vital capacity (VC) and maximum flow $Q_{MAX(LOAD)}$) is determined. From this information, the ideal loading profile is determined as explained above. The user then exhales normally through the device. During exhalation a low positive mouth pressure is maintained by the valve and control mechanism. This load is minimal and does not present a significant resistance to expiration.

After expiration, the user performs a second maximal inspiration, during which the device implements a load profile which varies with the volume of air inhaled and in accordance with the calculated ideal loading profile, but at a reduced proportion of the ideal load (for example, 25% of $P_{MAX}$). Loading during this inspiration is at a reduced level to avoid suddenly applying an unexpected high load on inspiration, but to provide a gradual introduction to loading. The user then exhales normally again while the valve maintains a substantially constant low positive mouth pressure.

The user then performs a third maximal inspiration during which the device implements the full training load (for example 50% of $P_{MAX}$) according to the calculated ideal loading profile. Loading at this level is then repeated for about 30 breaths in order to train the inspiratory muscles fully.

Alternatively, the magnitude of the decaying load may be manually altered during the course of a number of breaths in order to select a load which is most appropriate for the user.

The respiratory muscle training device according to the present invention can be used in conjunction with alternative procedures, for example by changing coefficients in the $P_{LOAD}$ equation, for example to alter the convexity of the resulting curve and/or the point of intersection with the x-axis.

The respiratory muscle training device according to the present invention may provide feedback to the user in any of a number of ways. For example, feedback may be provided by way of one or more user interfaces, such as an LCD screen, an audible buzzer, light emitting diodes (LEDs) or by connecting the device to an external computer. Feedback information may include measures of respiratory muscle performance, such as respiratory muscle strength (derived from mouth pressure), respiratory muscle power, respiratory muscle work during a training cycle and/or respiratory muscle endurance, and/or may include other physiological data such as lung volume and/or peak flows. Feedback information may also include guidance to the user, such as breathing rate guidance in order to optimise respiratory muscle recruitment whilst minimising faintness due to hyperventilation, or motivational guidance, such as indicators of when performance is decreasing and/or if personal best levels are exceeded.

Alternative loading protocols and respiratory manoeuvres allow the device according to the present invention to be adapted to perform other measures, such as maximum pressure-volume profile, flow-volume loop, dyspnoea score and airway resistance. The device may also be used to implement oscillating inspiratory and/or expiratory loading in order to aid mucous clearance, for example in patients with cystic fibrosis.

During expiration, the variable orifice valve arrangement and associated control mechanism can be used to implement a predetermined pressure, flow or resistance profile as with inspiration. As explained above, in order to implement expiratory loading more effectively, the orientation of the valve arrangement can be changed so as to provide a more effective valve seal so that a positive mouth pressure urges the valve plates together.

During an inspiratory muscle training routine, although the user exhales through the valve arrangement after each loaded inspiration, significant expiratory loading is not normally applied. Instead, the valve is used to maintain a substantially constant, positive, low value of mouth pressure which facilitates determination of the start and end points of a breath. That is, as the user starts to breathe out and mouth pressure increases the valve opens, and towards the end of expiration as flow decreases and mouth pressure drops the valve closes in order to maintain the predetermined pressure until the valve is completely closed and no expiratory flow is present.

The invention claimed is:

1. A respiratory muscle training device comprising a body portion (23) and a separable mouthpiece portion (25), the mouthpiece portion including:

a chamber (1) containing a variable orifice valve assembly (3);

an inlet (9) at a first side of the valve assembly permitting air to be inhaled into the chamber; and an outlet (11) at a second side of the valve assembly permitting air that has passed through the valve assembly to be inhaled by a user, and the body portion including:

a pressure sensor (7) for determining a pressure differential across the valve assembly;

means for determining the opening area of the valve assembly; and control means (15, 47, 49) including an actuator (49) for varying the orifice of the valve assembly of the mouthpiece portion (25) in dependence upon a pressure differential determined by the pressure sensor and upon an opening area of the valve assembly.

2. A device as claimed in claim 1, wherein the means for determining the opening area of the valve assembly (3) includes positional feedback means (59).

3. A device as claimed in claim 2, wherein the positional feedback means (50) is selected from an optical or magnetic encoder.

4. A device as claimed in claim 1, wherein the actuator (49) is selected from a stepper motor, a dc servomotor, and an ultrasonic motor.

5. A device as claimed in claim 1, wherein the valve assembly (3) includes a stationary first valve plate (31) having at least one aperture for the passage of air and a second valve plate (33) movable relative to the first valve plate and having at least one aperture for the passage of air.

6. A device as claimed in claim 5, wherein the second valve plate (33) is rotatable relative to the first valve plate (31).

7. A device as claimed in claim 5, wherein the first and second valve plates (31, 33) are each formed with a plurality of apertures in the form of a sector of a circle equally spaced around an axis of each valve plate and separated by solid regions of substantially the same dimensions as the apertures.

8. A device as claimed in claim 5, wherein the valve assembly (3) includes biasing means (37) urging the valve plates (31, 33) towards each other.

9. A device as claimed in claim 8, wherein the biasing means (37) comprises a coil spring.

10. A device as claimed in claim 5, wherein the valve assembly (3) includes an end stop (39) to limit relative movement between the first and second valve plates (31, 33).

11. A device as claimed in claim 5, wherein the first plate (31) is mounted in the chamber (1) in a manner which allows an amount of relative movement between the valve plate and the chamber.

12. A device as claimed in claim 5, wherein the movable valve plate (33) has a toothed portion (35) around at least a part of the periphery thereof for engaging the actuator forming part of the control means (15, 47, 49).

13. A device as claimed in claim 12, wherein the actuator transfers drive to the movable valve plate (38) by means selected from at least one gear (51) and a drive belt.

14. A device as claimed in claim 1, wherein the pressure sensor (7) includes a first port (53) upstream of the valve assembly (3) and a second port (55) downstream of the valve assembly.

15. A device as claimed in claim 1, wherein the control means (15, 47, 49) includes a signal conditioner (13) for converting an output signal of the pressure sensor (7) into a form adapted for input to the control means.

16. A device as claimed in claim 1, wherein the control means (15, 47, 49) includes a microprocessor (15) for determining the required opening of the orifice of the valve assembly (3).

17. A device as claimed in claim 16, wherein the microprocessor (15) controls the orifice to maintain at least one of a predetermined pressure differential, a flow rate, and a resistive load profile.

18. A device as claimed in claim 17, wherein the controlled parameter is varied.

19. A device as claimed in claim 18, wherein the controlled parameter is varied with at least one of volume and time.

20. A device as claimed in claim 1 and including feedback means (57) for providing information to a user.

21. A device as claimed in claim 20, wherein the feedback means comprises at least one of an LCD screen, an audible buzzer, light emitting diodes, connection (57) for an external computer, and tactile vibration feedback.

22. A device as claimed in claim 12, wherein the actuator includes a gearbox (47).

23. A device as claimed in claim 22, wherein the gearbox (47) includes an arcuate portion forming part of an interface with the mouthpiece portion (25).

24. A device as claimed in claim 14, wherein the first port (53) extends into an inlet region of an air passage through the mouthpiece portion (25) and the second port (55) is spaced from the first port and extends into an outlet region of the air passage.

* * * * *